US006592501B1

(12) United States Patent
Mayes

(10) Patent No.: US 6,592,501 B1
(45) Date of Patent: Jul. 15, 2003

(54) BACK REHAB EXERCISE TABLE

(75) Inventor: Billy Jack Mayes, 95 Deerwoode Lane, Brevard, NC (US) 28712

(73) Assignee: Billy Jack Mayes, Brevard, NC (US)

( * ) Notice: Subject to any disclaimer, the term of this patent is extended or adjusted under 35 U.S.C. 154(b) by 0 days.

(21) Appl. No.: 09/950,449

(22) Filed: Sep. 10, 2001

(51) Int. Cl.[7] ..... A63B 26/00

(52) U.S. Cl. ..... 482/142; 602/32; 482/907; 482/148

(58) Field of Search ..... 602/32; 482/907, 482/148, 904

(56) References Cited

U.S. PATENT DOCUMENTS 2,774,349 A * 12/1956 Judovich ..... 128/71
4,627,422 A * 12/1986 Bates ..... 606/244
4,802,465 A * 2/1989 Slagle ..... 606/244
4,867,143 A * 9/1989 Morin ..... 606/244
4,890,604 A * 1/1990 Nelson ..... 602/32
5,957,955 A * 9/1999 Thomas ..... 606/243

* cited by examiner

*Primary Examiner*—Nicholas D. Lucchesi
*Assistant Examiner*—Lori Baker Amerson

(57) ABSTRACT

An exercise table and exercise routine useful in treatment of low back pain is disclosed. The table design permits a users to apply low levels of traction to the lower back by pushing lightly on adjustable arm support posts. The table design permits the users to have complete control of the level of traction applied to the lower back. An exercise routine uses the methodology of relaxing the user and applying very low levels of traction to the lower back. The low level of traction is alternated every few seconds and utilizes deep breaths to keep the user in a relaxed condition.

3 Claims, 3 Drawing Sheets

Isometric View

Top View

Side View

BACK REHAB EXERCISE TABLE

REFERENCES CITED

| References Cited: | | |
|---|---|---|
| 4,582,311 | April, 1986 | Steffensmeier |
| 4,995,378 | February, 1991 | Dyer, et al. |
| 5,217,487 | June, 1993 | Engel, et al. |
| 5,403,258 | April, 1995 | Hill |
| 5,667,529 | September, 1997 | Butner |
| 6,007,507 | December, 1999 | Ledany |
| 6,152,950 | November, 2000 | Shealy, et al. |
| 09/802,012 | March 9, 2001 | Mayes |

FIELD OF INVENTION

The present invention generally relates to the therapeutic treatment of the back and more particularly to the treatment of the lower back.

BACKGROUND OF INVENTION

Back troubles affect millions of people each year. Pain in the lower lumbar area of the back is the most common back difficulty. In response to this frequent problem, numerous treatments have been developed, recommended, and practiced. These treatments involve exercise therapy, specialized equipment, and even surgery to relieve the discomfort associated with lower back trauma.

Lower back therapy usually involves procedures that stretch or elongate the spine and decompress the vertebrae that contribute to back pain. Common procedures use various forms of traction using weights and even the individuals own body weight to stretch the back and provide pain relief Procedures that use the patient's weight and suspend the person in an inverted, head-down position have been and are currently being used to stretch and decompress the back. Using gravity and the individual's body weight to stretch the back in this fashion has several disadvantages. In order for the back to properly decompress the person must be relaxed and hanging in an inverted state is not a relaxed position due to fear and to discomfort from being inverted. Supporting body weight with arms or elbows or being suspended in an inverted position may give a feeling of relief initially but after a short time muscles tighten and reduce and even eliminate the spinal relaxation required to alleviate the pain. When muscles become tense, the spine is prevented from decompressing and the relief is limited.

Therapeutic tables have been utilized for applying traction to the users lumbar region and achieving pain relief These procedures involve the individual lying horizontal, either face down or face up, on the table and mechanical traction is applied to stretch or decompress the affected area of the back. Traction is usually applied to the back using weights and pulleys. More recently, tables have been proposed that have movable sections where the individual is held fixed and traction is obtained by separation of the table sections. The separation of the table sections and the application of traction has been accomplished using cables and a winch, hydraulic cylinders, and a motor driven device.

Although various therapeutic traction tables are disclosed, few provide the user complete control of the amount of traction and stretch applied to their back and none provided specific procedures and methodology to utilize very low levels of traction to relieve back pain. The relief of back pain can best be accomplished when the back and the body in general are in a relaxed condition. The muscles that surround and protect the spine must be relaxed to permit the spine to be stretched and decompressed. Traction without relaxation will not successfully relieve the pressures that contribute to back pain.

BRIEF SUMMARY OF THE INVENTION

According to this invention, an exercise table is described that permits an individual to apply very low levels of traction to the lower back. A user driven routine is also described that enables the body, especially the back, to relax allowing the lower spine to be efficiently and effectively stretched and decompressed. The exercise table is constructed with an 11-degree slope and has a smooth, hard surface. The 11-degree slope creates just enough downward gravitational force to make the exercises effective without being uncomfortable for the user. The table design provides foot brackets for attaching the feet using a simple harness.

The force needed to stretch and decompress the back is generated by the user lightly pushing against padded posts that are attached to the upper part of the table. Each user determines and controls the level of traction applied to the back. The traction is not constant but is alternated every few seconds using deep breaths to keep the body in a relaxed condition.

The table design and the harnesses used permit the feet and arms to be easily disconnected, allowing specific body movements that assist in treating lower lumbar pain. The procedural methodology that is used by the user while on the table is very important for successful reduction and even elimination of back pain. Using the table and applying traction to the lower back without using the methodology to achieve relaxation and muscle stretch, will result in a less successful outcome. The design of the table is important in that it provides a means for the user to apply the proper amount of traction to stretch and decompress the back. The procedures and methods described in this invention are, however, equally important for relieving lower back pain.

The table described in this invention is designed to permit the user to control the traction applied to the back and permit a slow extension of the lower back. The table also permits the user to move and stretch out of plane with one leg while retaining the other leg in a stretched condition. The amount of traction applied to the back is very low and is.easily controlled by the user. This control and the procedures described in this invention permit the user to relax and allow the low traction forces to gently stretch the back. The relaxation of the muscles in the back is important and significantly impacts the success of this form of treatment.

DETAILED DESCRIPTION OF THE INVENTION

Figure 1:
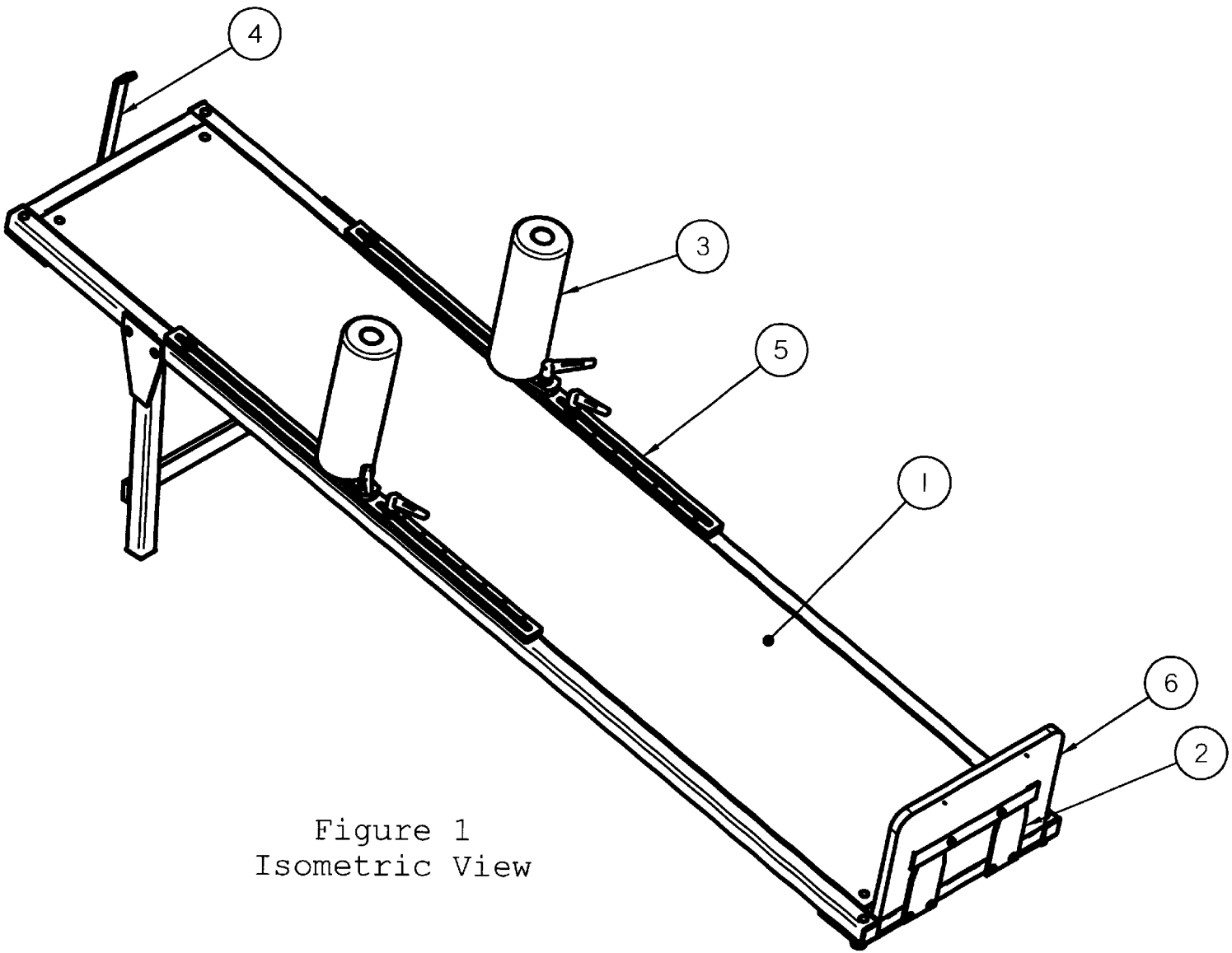
FIG. 1 is a perspective view of the table that incorporates the principles of the invention and shows the major components of the design.
Figure 2:
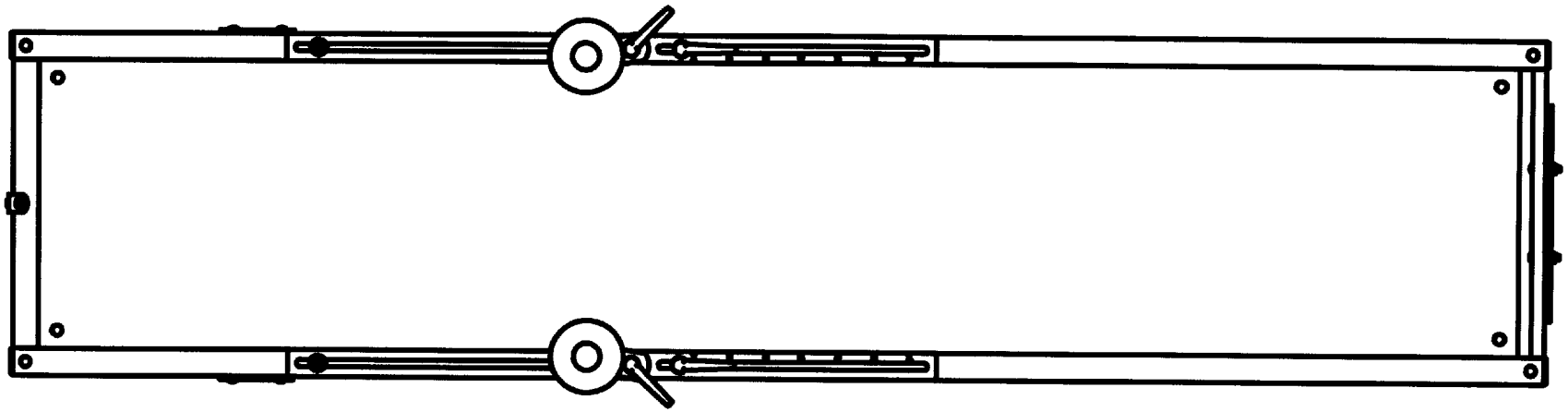
FIG. 2 is a top view of the table.
Figure 3:
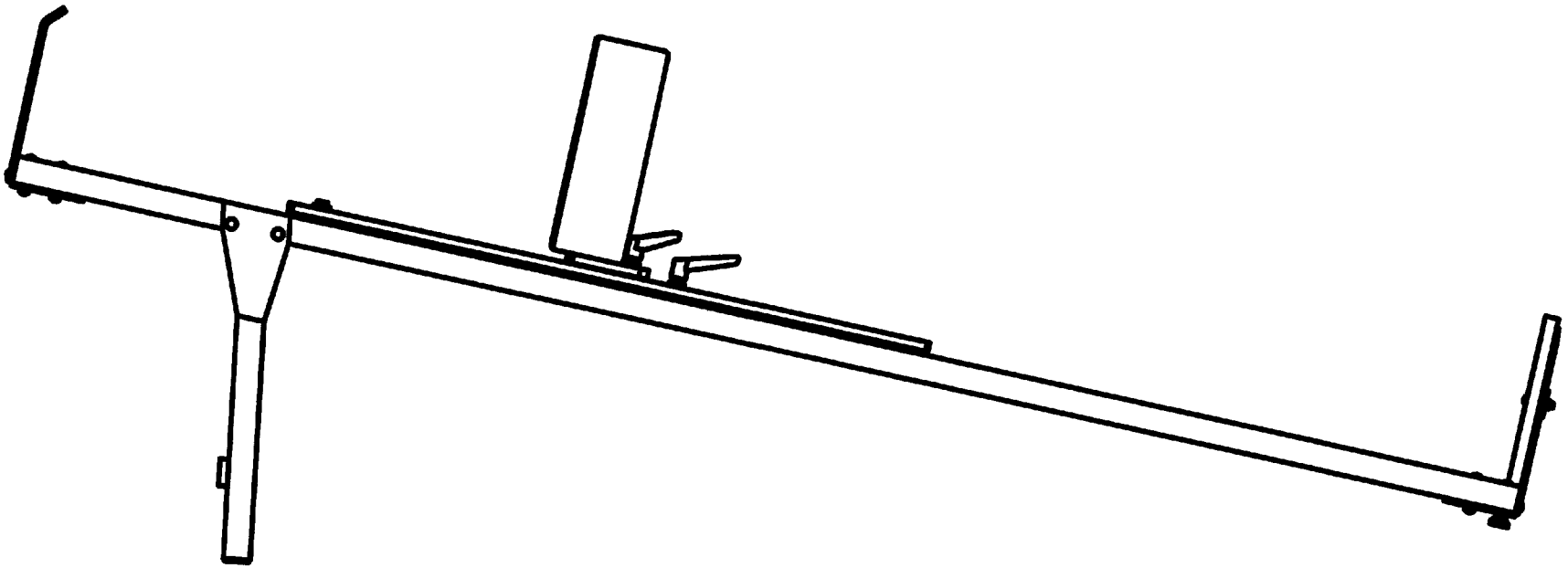
FIG. 3 is a side view of the table.

The exercise table described in this invention is shown in FIGS. 1, 2, and 3. Referring to FIG. 1, the table frame 1 is 85 inches long and 19 inches wide. The frame legs are 18 inches high at the head end of the table with the foot end sitting on the floor. This creates an 11-degree incline, with the head being higher than the feet. The table is provided with two flat foot pegs 2 at the lower end to attach a harness that is placed on each of the user's feet. The harnesses may be attached or unattached by sliding the harness over the flat foot pegs. The table contains arm posts 3 that are attached to the side of the table frame. The arm posts are 12 inches long and are covered with a 1 inch thickness of foam resulting in a total diameter of 3.5 inches. The arm posts support the user's arms. The arm posts are adjustable 5 to accommodate individuals from 5 feet 0 inches to 6 feet 8 inches in height and with chest widths ranging from 12 inches to 18 inches. For users having knee or hip problems, such as knee or hip replacements, a pelvic harness should be used. The table also contains a support 4 to attach a neck harness. A cushion is used to support the user's head. A foot board 6 can be slid over the foot pegs.

The use of the table begins by adjusting the arm posts in height and width to generally fit under the user's arms. A simple harness is attached to the user's feet. The user lies on the table face-up and the feet are attached by sliding the harness on each foot over the appropriate foot peg. The user's arms are placed over the arm posts and the arm posts are readjusted to be comfortable for the user and to remove any slack in the harness or position of the body on the table. When the user is positioned correctly the back of their arms or triceps will be parallel against the arm posts and their hands are placed on their forehead. This has been found to be a very comfortable position. While snuggly fitted in the table, the user can very simply apply traction to the lower back by pushing the back of the arms against the arm posts. A male will normally develop between 10 to 20 pounds of downward pressure by pushing lightly on the arm posts while a female will generate from 5 to 10 pounds of pressure by pushing on the arm posts.

The table is designed to permit the user to apply low amounts of traction to stretch the lower back and relieve pain. In order for the back to respond to the low levels of traction, it is extremely important for the user to be relaxed. The treatment routine generally includes several steps to initially relax the user and begin to elongate the back followed by steps to further stretch the back and to build the muscles in the lower back. In order to relax, it is important for the user to be comfortable on the table and to understand that they are in control of the traction applied to the back. It is also important for the user to understand that very low levels of traction are required to stretch the lower back. The initial treatment steps permit the user to become comfortable on the table while lightly stretching the lower back. The additional treatment sets elongate the back and provide exercises that strengthen the muscles in the lower back.

A treatment procedure that has been successfully employed in relieving lower back pain is described below. It is recognized that other procedures may also be used with the table but the treatment described below has proven successful on a variety of users.

Step 1. Tighten and suck in the lower stomach as far as possible toward the backbone, start a deep, lower-stomach upward stretching breath, and apply slight pressure with the triceps against each post. The feet should pull away from the foot board. Immediately release the pressure and relax slowly. Repeat 10 times.

Step 2. Relax: Knead your feet, legs, and hips by gently pulling one foot away from the foot board while keeping both legs straight. Repeat for the other foot. Alternate this procedure 10 times. This should be very relaxing.

Step 3. As in Step 1, tighten and suck in the stomach as much as possible toward the backbone, start a deep, lower-stomach upward stretching breath, and apply slight pressure to the triceps against each post. The feet should pull away from the foot board. This time, hold the pressure for 10 seconds then release the pressure and relax slowly. Repeat 5 times.

Relax by kneading feet, legs, and hips.

Step 4. Knead under pressure. Tighten and suck in the stomach as far as possible toward the backbone, start a deep, lower-stomach upward stretching breath, and apply slight pressure with the triceps against.each post. The feet should pull away from the foot board. While holding this pressure, knead each hip 5 times. Release the pressure and relax slowly.

Relax by kneading feet, legs, and hips.

Step 5. As in Step 1, tighten and suck in the stomach as much as possible toward the backbone, start a deep, lower-stomach upward stretching breath, and apply slight pressure with the triceps against each post. The feet should pull away from the foot board. Hold this pressure for 10 seconds. Release the pressure and relax slowly. Repeat 1 time.

Relax by kneading feet, legs, and hips.

Step 6. For further relaxation and stretching, draw the legs up to a 45-degree angle with the feet flat against the table, hold onto the posts, and roll both legs over to one side. Hold this position for 10 seconds, then roll slowly to the opposite side. Repeat 1 time each side.

Relax by kneading feet, legs, and hips.

Step 7. Tighten the buttocks as much as possible, tighten and suck in the stomach toward the backbone, take a deep upward stretching breath, and push triceps against the posts. Release and relax, very slowly. Repeat 10 times.

Relax by kneading feet, legs, and hips.

Step 8. Pull the right foot away from the foot board. Fold the right leg to the chest, keeping the right arm around the post. Lift the left arm from around the left post and grasp the right knee with both hands. Create a slight stretch of the hips and back and hold for 10 seconds. Release, then cross the right leg over the body, put the left arm around the left post, lift the right arm and grasp the right knee with both hands. Create a slight stretch of the hips and back and hold for 20 seconds. Relax this position and exercise the other leg.

Relax by kneading feet, legs, and hips.

Step 9. Draw one leg up and gently roll the bent leg over across the body. Straighten the leg as much as can be tolerated without hurting. This is a.very aggressive stretch but really helps to loosen the back muscles. Hold for 10 seconds, then exercise the other leg.

Relax by kneading feet, legs, and hips.

The table described in FIGS. 1, 2, and 3 permits an individual with lower back pain to easily apply low levels of traction to the lower back. The level of traction is totally controlled by the user pushing on arm support posts. An exercise routine enables the user to relax and stretches and decompresses the back by alternating traction and deep breaths every few seconds. The exercise routine includes steps that strengthen the muscles of the lower back. Other routines may be described or developed but the routine described herein has proven to successfully relieve lower back pain in a large number of users.

What is claimed is:

1. An exercise table and a methodology for exercising that is useful in the treatment of low back pain while building muscle and flexibility in and around the stomach and back which helps correct and prevent future back problems, The exercise table comprising:

a frame sufficiently long and wide to support the user;

a smooth table surface that is inclined at an angle from 9 to 16 degrees with the foot end lower than the head end;

a pair of adjustable arm support posts that are attached to said table frame that provide traction means applied to the user back at low levels by applying light pressure on the arm support posts and;

a methodology of applying low levels of traction to the users lower back; comprising the steps of alternating the low traction force every few seconds with deep upward stretching breaths followed by periods of relaxation to maintain the user in a relaxed and pliant condition.

2. The routine according to claim 1, wherein exercises are used to strengthen the lower back muscles while the back is under traction.

3. The table according to claim 1, wherein the legs and arm support posts are removable for shipment and storage.

* * * * *